US008592355B2

(12) United States Patent
Ito

(10) Patent No.: US 8,592,355 B2
(45) Date of Patent: Nov. 26, 2013

(54) ENGINE OIL COMPOSITION

(75) Inventor: Koki Ito, Ichihara (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 1198 days.

(21) Appl. No.: 11/422,178

(22) Filed: Jun. 5, 2006

(65) Prior Publication Data

US 2006/0287203 A1 Dec. 21, 2006

(30) Foreign Application Priority Data

Jun. 17, 2005 (JP) ..... 2005-178381

(51) Int. Cl.
*C10M 159/18* (2006.01)
*C10M 137/10* (2006.01)
*C10M 125/20* (2006.01)

(52) U.S. Cl.
USPC ..... 508/362; 508/165; 508/363; 508/368

(58) Field of Classification Search
USPC ..... 508/362, 165, 363, 368
See application file for complete search history.

(56) References Cited

U.S. PATENT DOCUMENTS

| | | | | |
|---|---|---|---|---|
| 5,605,880 | A | 2/1997 | Arai et al. | |
| 6,074,993 | A * | 6/2000 | Waddoups et al. | 508/364 |
| 6,140,282 | A * | 10/2000 | Cartwright et al. | 508/398 |
| 6,444,624 | B1 | 9/2002 | Walker et al. | |
| 2003/0224949 | A1 * | 12/2003 | Ruhe et al. | 508/242 |
| 2004/0038833 | A1 | 2/2004 | Deckman et al. | |

FOREIGN PATENT DOCUMENTS

| | | |
|---|---|---|
| EP | 1 416 034 A1 | 5/2004 |
| GB | 2 078 230 A | 1/1982 |
| JP | 57-16095 | 1/1982 |
| JP | 03-022438 | 3/1991 |
| JP | 6-313183 | 11/1994 |
| JP | 8-283762 | 10/1996 |
| JP | 9-328694 | 12/1997 |
| JP | 2000-053991 | 2/2000 |
| JP | 2001-098286 | 4/2001 |
| JP | 2001-158897 | 5/2001 |
| JP | 2003-253289 | 9/2003 |
| JP | 2004-002710 | 1/2004 |
| JP | 2004-2866 | 1/2004 |
| JP | 2005-139162 | 6/2005 |
| JP | 2005-516107 | 6/2005 |

OTHER PUBLICATIONS

Office Action issued Apr. 24, 2012, in Japanese Patent Application No. 2005-178381 (with English-language translation).

Japanese Office Action dated May 17, 2011 as received in the corresponding Japanese Patent Application No. JP2005-178381.

* cited by examiner

*Primary Examiner* — Jim Goloboy

(74) *Attorney, Agent, or Firm* — Oblon, Spivak, McClelland, Maier & Neustadt, L.L.P.

(57) ABSTRACT

An engine oil composition obtained by compounding: (A) a base oil mixture including a first base oil and a second base oil, the first base oil having a kinematic viscosity of 2 to 50 $mm^2/s$ at 100° C., a viscosity index of 80, and a sulfur content of less than 0.03 mass %, the second base oil having a kinematic viscosity of 2 to 50 $mm^2/s$ at 100° C., a viscosity index of 60, and a sulfur content of 0.03 mass % or more; (B) an oil-soluble molybdenum-containing composition; and (C) a molybdenum-based friction modifier; in which, based on the total amount of engine oil composition, the content of the second base oil is 0.1 to 15 mass %, the content of (B) oil-soluble molybdenum-containing composition is 10 to 1000 mass ppm in terms of amount of molybdenum, and the content of (C) molybdenum-based friction modifier is 100 to 1000 mass ppm in terms of amount of molybdenum.

10 Claims, No Drawings

ENGINE OIL COMPOSITION

BACKGROUND OF THE INVENTION

1. Field of the Invention

The present invention relates to an engine oil composition excellent in high-temperature detergency and low fuel consumption characteristic.

2. Description of Related Art

Engine oil is conventionally used, in a circulating manner, in an internal combustion engine for lubricating various slide portions such as sliding surfaces between a piston ring and a cylinder liner, bearings of a crankshaft and a connecting rod, valve systems including cams and valve lifters, drive devices such as an oil pump and a distributor.

In such an internal combustion engine, since the temperature between the piston ring and the cylinder liner is very high, a soot-like substance called "deposit" is generated, and the generated deposit adheres around a piston-ring groove. The deposit is considered to be derived from engine oil and fuel under the influence of heat and oxygen. The performance of the internal combustion engine (especially low fuel consumption characteristic) will be seriously affected if the amount of the deposit increases. Thus there has been a desire for an engine oil which produces minimum deposit, namely, an engine oil which has so called high-temperature detergency.

In order to prevent the deposit from being generated and maintain low fuel consumption characteristic for long period of time, an engine oil composition obtained by adding a molybdenum-contained friction modifier and a boron compound into a base oil has been proposed (refer to, for example, Document 1: Japanese Patent Laid-Open Publication No. Hei08-283762).

Another proposal which can prevent the deposit from being generated at high temperature is an engine oil composition having kinematic viscosity of 2-13cSt at 100° C. and containing 1 wt. % (based on the total amount of the composition) or more base oil that has boiling point of 480° C. or higher measured by gas chromatograph distillation (refer to, for example, Document 2: Japanese Patent Laid-Open Publication No. Hei09-328694).

However, moisture will generally be generated inside an engine along with combustion of fuel (gasoline, diesel oil, etc.), therefore in the case where the engine oil composition described in Document 1 is used, hydrolysis reaction will happen due to the contact between the boron compound and the moisture, so as to form a gel substance. Accordingly, it will be not enough to prevent the deposit from generating.

Further, a lower engine oil viscosity will generally lead to a lower stirring resistance, namely lead to a low fuel consumption characteristic. Since the engine oil composition described in Document 2 contains heavy component having boiling point of 480° C. or higher, it will have high viscosity at low temperature, and thereby the low fuel consumption characteristic at cold start will be impaired.

SUMMARY OF THE INVENTION

It is a primary object of the present invention to provide an engine oil composition having high-temperature detergency, suitable viscosity, low temperature dependency of the viscosity, and low fuel consumption characteristic.

An engine oil composition according to the present invention is obtained by compounding: (A) a base oil mixture including a first base oil and a second base oil, the first base oil having a kinematic viscosity of 2 to 50 $mm^2/s$ at 100° C., a viscosity index of 80 or higher, and a sulfur content of less than 0.03 mass %, the second base oil having a kinematic viscosity of 2 to 50 $mm^2/s$ at 100° C., a viscosity index of 60 or higher, and a sulfur content of 0.03 mass % or more; (B) an oil-soluble molybdenum-containing composition; and (C) a molybdenum-based friction modifier; in which, based on the total amount of engine oil composition, the content of the second base oil is 0.1 to 15 mass %, the content of (B) oil-soluble molybdenum-containing composition is 10 to 1000 mass ppm in terms of amount of molybdenum, and the content of (C) molybdenum-based friction modifier is 100 to 1000 mass ppm in terms of amount of molybdenum.

Herein, (B) the oil-soluble molybdenum-containing composition is manufactured by the following processes (m) and (n).

Process (m): a molybdenum complex is prepared by reacting an acid molybdenum compound or a salt thereof with a basic nitrogen compound selected from the group composed of succinimide, carboxylic acid amide, hydrocarbon monoamine, hydrocarbon polyamine, Mannich base, phosphonic amide, thiophosphonic amide, phosphoric acid amide, dispersant type viscosity index improver and mixtures thereof, the reaction temperature being maintained at 120° C. or lower.

Process (n): the product of the process (m) is subjected to either a stripping process or a sulfurizing process, or subjected to the both processes. It will be necessary to take sufficient time and maintain the temperature of the reaction mixture of the stripping process or the sulfurizing process to about 120° C. or lower in order to obtain an oil-soluble molybdenum-containing composition having a light absorbance of less than 0.7 at a wavelength of 350 nm (the value is acquired by measuring a diluted molybdenum-containing composition with a UV-visible spectrophotometer by using a quartz cell of 1 cm optical path, the diluted molybdenum-containing composition being obtained by diluting the molybdenum-containing composition with isooctane to a concentration which contains 0.00025 g molybdenum based on 1 g of the diluted molybdenum-containing composition).

Further, the oil-soluble molybdenum-containing composition also can be manufactured by the following processes (o), (p), and (q).

Process (o): a molybdenum complex is prepared by reacting an acid molybdenum compound or a salt thereof with a basic nitrogen compound selected from the group composed of succinimide, carboxylic acid amide, hydrocarbon monoamine, hydrocarbon polyamine, Mannich base, phosphonic amide, thiophosphonic amide, phosphoric acid amide, dispersant type viscosity index improver and mixtures thereof, the reaction temperature being maintained at 120° C. or lower.

Process (p): the product of the process (o) is subjected to a stripping process at about 120° C. or lower.

Process (q): the obtained product is sulfurized with sufficient time under a condition in which the temperature is about 120° C. or lower and the molar ratio of the sulfur and the molybdenum is 1:1 or smaller, to obtain an oil-soluble molybdenum-containing composition having a light absorbance of less than 0.7 at a wavelength of 350 nm (the value is acquired by measuring a diluted molybdenum-containing composition with a UV-visible spectrophotometer by using a quartz cell of 1 cm optical path, the diluted molybdenum-containing composition being obtained by diluting the molybdenum-containing composition with isooctane to a concentration which contains 0.00025 g molybdenum based on 1 g of the diluted molybdenum-containing composition).

Since the engine oil composition according to the present invention is obtained by compounding the base oil mixture, which is the component (A) containing the first base oil and the second base oil respectively having characteristics as described above, with (B) oil-soluble molybdenum-containing composition, which is obtained by a specified manufacturing method, and (C) molybdenum-based friction modifier as additives, and since the compounding amounts of the second base oil, the component (B), and the component (C) respectively fall in specified ranges, the generation of the deposit can be restrained even when temperature inside the engine becomes high.

Though its structure is not known in detail, the component (B) (i.e. the oil-soluble molybdenum-containing composition obtained by the above processes) is considered to provide the engine oil composition with a high effect of restraining the generation of the deposit in combination with the effect of the component (C) (i.e. the molybdenum-based friction modifier), when the second base oil is in an specified range of 0.1 to 15 mass % based on the total amount of the composition. It is preferred that a molybdenum dialkyldithiocarbamate (hereinafter referred to as MoDTC) is used as the molybdenum-based friction modifier, in view of the effect of reducing friction.

Further, since the sulfur content of the second base oil is 0.03 mass % or more, friction and wear generated on each portion of the engine can be reduced due to the lubricating effect of the second base oil, thereby the generation of the deposit can be restrained.

Further, since the first base oil and the second base oil respectively have kinematic viscosity and viscosity index within suitable ranges, the base oil mixture also has kinematic viscosity and viscosity index within suitable ranges, therefore the engine oil composition has low temperature dependency of the viscosity and low fuel consumption characteristic.

It is preferred that the engine oil composition according to present invention further contains (D) an amine-based antioxidant in an amount of 50 to 2,000 mass ppm in terms of amount of nitrogen based on the total amount of engine oil composition.

According to the present invention, since the amine-based antioxidant is contained in a specified amount, in combination with (B) oil-soluble molybdenum-containing composition and (C) molybdenum-based friction modifier, better effect of restraining the generation of the deposit can be obtained.

Further, it is preferred in the present invention that the first base oil has a saturated hydrocarbon content of 90 mass % or more.

According to the present invention, since the saturated hydrocarbon content of the first base oil is 90 mass % or more, the oxidation stability of the engine oil composition can be improved.

Further, it is preferred in the present invention that the second base oil has a saturated hydrocarbon content of 90 mass % or less.

According to the present invention, since the saturated hydrocarbon content of the second base oil is 90 mass % or less, the effect of the engine oil composition in restraining the generation of the deposit can be improved.

DETAILED DESCRIPTION OF PREFERRED EMBODIMENT(S)

Preferred embodiments of the present invention will be described below.

In an engine oil composition of the present invention, a component (A) is so called a "base oil mixture" which contains a base oil (a) and a base oil (b).

The base oil (a) should have a kinematic viscosity of 2 to 50 $mm^2/s$, preferably of 3 to 30 $mm^2/s$, and particularly preferably of 4 to 25 $mm^2/s$, at 100° C. If the kinematic viscosity is lower than 2 $mm^2/s$ at 100° C., evaporation loss will possibly increase, which is not desirable. While if the kinematic viscosity is higher than 50 $mm^2/s$, power loss will possibly increase due to viscous resistance, and thereby effect of gaining low fuel consumption characteristic can not be attained, which is not desirable.

Further, the base oil (a) should have a viscosity index of 80 or higher, preferably of 90 or higher, and particularly preferably of 100 or higher. If the viscosity index of the base oil is lower than 80, viscosity change due to temperature change will possibly become large, which is not desirable.

Though the viscosity index of the base oil (a) can be improved by controlling the production of the base oil itself as mentioned below, a preferable way to improve the viscosity index of the base oil is adding a viscosity index improver. Examples of the viscosity index improver include: 1-18C polyalkyl methacrylate, 1-18C alkyl acrylate/1-18C alkyl methacrylate copolymer, diethylaminoethyl methacrylate/1-18C alkyl methacrylate copolymer, ethylene/1-18C alkyl methacrylate copolymer, polyisobutylene, polyalkylstyrene, ethylene/propylene copolymer, styrene/maleic acid ester copolymer, styrene/maleic acid amide copolymer, hydrogenated styrene/butadiene copolymer, and hydrogenated styrene/isoprene copolymer. The average molecular weight should be about 10,000 to 1,500,000, The compounding amount of the viscosity index improver is preferably 0.1 to 20 mass % based on the content of the lubricant base oil (a).

Further, sulfur content of the base oil (a) should be less than 0.03 mass %. If the sulfur content exceeds 0.03 mass %, effect of an oil-soluble molybdenum-containing composition, which is a below-mentioned component (B), will become small.

The sulfur content can be measured in accordance with, for example, JIS K2541 "crude oil and petroleum product: measuring method for sulfur content"

Herein, the base oil (a) can be a mineral oil or a synthetic oil. The mineral oil can be, for example, a distillate either obtained by atmospheric distillation of a paraffinic crude oil, an intermediate crude oil, or a naphthenic crude oil, or obtained by vacuum distillation of an atmospheric distillation residual oil; or a refined oil obtained by refining the distillate according to a conventional method, such as a solvent refined oil, a hydrogenated refined oil, a dewaxing-treated oil, a white clay treated oil, or the like. By respective processes of the above, a base oil having low sulfur content, a predetermined kinematic viscosity and a predetermined viscosity index can be manufactured.

Examples of the synthetic oil include, for example, poly-α-olefin (which is an α-olefin oligomer having from 8 to 14 carbon atoms), polybutene, polyol ester, and alkylbenzene. Any one of these compounds having a predetermined kinematic viscosity and a predetermined viscosity index can be selected as the synthetic oil.

In the present invention, the above-mentioned mineral oils and the above-mentioned synthetic oils can be used alone or as combined, or the base oil can be used by combining two or more components. Further, the base oil can be a mixture of the mineral oil and the synthetic oil.

The base oil (b) of the engine oil composition according to the present invention should have a kinematic viscosity of 2 to 50 $mm^2/s$, preferably of 3 to 30 $mm^2/s$, and particularly preferably of 4 to 25 $mm^2/s$, at 100° C. If the kinematic viscosity is lower than 2 $mm^2/s$ at 100° C., evaporation loss will possibly increase, which is not desirable. While if the kinematic viscosity is higher than 50 $mm^2/s$, power loss will possibly increase due to viscous resistance, and thereby effect of gaining low fuel consumption characteristic can not be attained, which is not desirable.

Further, it is preferred that the base oil (a) has a saturated hydrocarbon content of 90 mass % or more. Oxidation stability of the engine oil composition can be improved if the saturated hydrocarbon content of the base oil (a) is 90 mass % or more.

Further, the base oil (b) should have a viscosity index of 60 or higher, preferably of 80 or higher, and particularly preferably of 90 or higher. If the viscosity index of the base oil is lower than 60, viscosity change due to temperature change will possibly become large, which is not desirable. Regarding the use of the viscosity index improver, points are the same as in the case of the above lubricant base oil (b).

Further, sulfur content of the base oil (b) should be 0.03 mass % or more. Lubricating performance of the engine oil can be improved if the sulfur content is 0.03 mass % or more. However, if the sulfur content is too high, not only oxidation stability will be reduced, but also the effect of various kinds of additives will be reduced. Therefore the sulfur content is preferably 0.05 to 1 mass %, more preferably 0.05 to 0.8 mass %.

Further, the content of the base oil (b) should be 0.1 to 15 mass % based on the total amount of the composition. If the content of the base oil (b) is less than 0.1 mass %, the deposit generated after running the engine for a specified period will increase. The deposit will also increase if the content of the base oil (b) is more than 15 mass %. The content of the base oil (b) is preferably 1 to 13 mass %, more preferably 3 to 10 mass and particularly preferably 5 to 10 mass %.

Namely, if the content of the base oil (b) comes off this range, the effect of various kinds of additives for reducing the deposit (the details will be described later) will become difficult to achieve.

The base oil (b) can be a mineral oil, and the manufacturing method thereof can be the same as that of the above-mentioned base oil (a). However, degree of refining needs to be controlled so as to control the sulfur content to 0.03 mass % or more.

Further, it is preferred that the base oil (a) has a saturated hydrocarbon content of 90 mass % or less. If the saturated hydrocarbon content of the base oil (b) is 90 mass % or less, the effect of the engine oil composition in restraining the generation of the deposit can be improved.

The component (B), which is an additive to be added to the base oil mixture, is an oil-soluble molybdenum-containing composition that can be obtained by the method described in Japanese Patent Publication No. 2004-2866, Specifically, the component (B) can be manufactured by the following processes (m) and (n).

Process (m): a molybdenum complex is prepared by reacting an acid molybdenum compound or a salt thereof with a basic nitrogen compound selected from the group composed of succinimide, carboxylic acid amide, hydrocarbon monoamine, hydrocarbon polyamine, Mannich base, phosphonic amide, thiophosphonic amide, phosphoric acid amide, dispersant type viscosity index improver and mixtures thereof, the reaction temperature being maintained at about 120° C. or lower.

Process (n): the product of the process (m) is subjected to either a stripping process or a sulfurizing process, or subjected to both the stripping process and the sulfurizing process. It will be necessary to take sufficient time and maintain the temperature of the reaction mixture of the stripping process or the sulfurizing process to about 120° C. or below in order to obtain an oil-soluble molybdenum-containing composition having a light absorbance of less than 0.7 at a wavelength of 350 nm (the value is acquired by measuring a diluted molybdenum-containing composition with a UV-visible spectrophotometer by using a quartz cell of 1 cm optical path, the diluted molybdenum-containing composition being acquired by diluting the molybdenum-containing composition with isooctane to a concentration which contains 0.00025 g molybdenum based on 1 g of the diluted molybdenum-containing composition).

Further, the oil-soluble molybdenum-containing composition also can be manufactured by the following processes (o), (p), and (q).

Process (o): a molybdenum complex is prepared by reacting an acid molybdenum compound or a salt thereof with a basic nitrogen compound selected from the group composed of succinimide, carboxylic acid amide, hydrocarbon monoamine, hydrocarbon polyamine, Mannich base, phosphonic amide, thiophosphonic amide, phosphoric acid amide, dispersant type viscosity index improver and mixtures thereof, the reaction temperature being maintained at about 120° C. or below.

Process (p): the product of the process (o) is subjected to a stripping process at about 120° C. or lower.

Process (q): the obtained product is sulfurized with sufficient time under a condition in which the temperature is about 120° C. or below and the molar ratio of the sulfur and the molybdenum is 1:1 or smaller, to obtain an oil-soluble molybdenum-containing composition having a light absorbance of less than 0.7 at a wavelength of 350 nm (the value is acquired by measuring a diluted molybdenum-containing composition with a UV-visible spectrophotometer by using a quartz cell of 1 cm optical path, the diluted molybdenum-containing composition being acquired by diluting the molybdenum-containing composition with isooctane to a concentration which contains 0.00025 g molybdenum based on 1 g of the diluted molybdenum-containing composition).

Though the detailed structure of the oil-soluble molybdenum-containing composition obtained in the above processes is unclear, it is presumed that by adding the oil-soluble molybdenum-containing composition into the base oil mixture, i.e. the component (A), oxidation resistance effect can be improved, and the generating the deposit inside the engine can be restrained.

The amount of the oil-soluble molybdenum-containing composition of the engine oil composition according to the present invention should be 10 to 1000 mass ppm, in terms of amount of molybdenum, based on the total amount of engine oil composition. If the amount of the oil-soluble molybdenum-containing composition is less than 10 mass ppm, the effect of restraining the deposit will be insufficient; while if the amount of the oil-soluble molybdenum-containing composition exceeds 1000 ppm, the effect of restraining the deposit will not be further improved. The content of the oil-soluble molybdenum-containing composition is preferably 30 to 800 mass ppm, more preferably 50 to 500 mass ppm.

The component (C), which is an additive added to the above base oil mixture, is a molybdenum-based friction modifier selected from: molybdenum dithiocarbamate (MoDTC), molybdenum dithiophosphate (hereinafter referred to as MoDTP), and molybdic acid amine salt (hereinafter referred to as Mo amine salt). The MoDTC is represented by the following general formula (I).

(I)

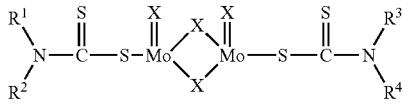

In the general formula (I), R1-R4 are a hydrocarbon group having from 5 to 16 carbon atoms, and R1-R4 may be the same or different from each other. The X is S (sulfur atom) or O (oxygen atom). Examples of the hydrocarbon group represented by R1-R4 include: an alkyl group having from 5 to 16 carbon atoms, an alkenyl group having from 5 to 16 carbon atoms, a cycloalkyl group having from 5 to 16 carbon atoms, an alkylaryl group having from 5 to 16 carbon atoms, and an arylalkyl group having from 5 to 16 carbon atoms. Concrete examples of the hydrocarbon having from 5 to 16 carbon atoms include: various pentyl group, various hexyl group, various heptyl group, various octyl group, various nonyl group, various decyl group, various undecyl group, various dodecyl group, various tridecyl group, various tetradecyl group, various pentadecyl group, various hexadecyl group, various octenyl group, various nonenyl group, various decenyl group, various undecenyl group, various dodecenyl group, various tridecenyl group, various tetradecenyl group, various pentadecenyl group, cyclohexyl group, dimethylcyclohexyl group, ethylcyclohexyl group, methylcyclohexylmethyl group, cyclohexylethyl group, propylcyclohexyl group, butylcyclohexyl group, heptylcyclohexyl group, phenyl group, tolyl group, dimethylphenyl group, butylphenyl group, nonylphenyl group, methylbenzyl group, phenylethyl group, naphthyl group, and dimethylnaphthyl group. The MoDTP is represented by the following general formula (II).

(II)

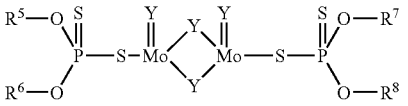

In the general formula (II), R5-R8 are a hydrocarbon group having from 5 to 16 carbon atoms, and R5-R8 may be the same or different from each other. The Y is S (sulfur atom) or O (oxygen atom). Examples of the hydrocarbon group represented by R5-R8 include: an alkyl group having from 5 to 16 carbon atoms, an alkenyl group having from 5 to 16 carbon atoms, a cycloalkyl group having from 5 to 16 carbon atoms, an alkylaryl group having from 5 to 16 carbon atoms, and an arylalkyl group having from 5 to 16 carbon atoms. Concrete examples of the hydrocarbon having from 5 to 16 carbon atoms include: various pentyl group, various hexyl group, various heptyl group, various octyl group, various nonyl group, various decyl group, various undecyl group, various dodecyl group, various tridecyl group, various tetradecyl group, various pentadecyl group, various hexadecyl group, various octenyl group, various nonenyl group, various decenyl group, various undecenyl group, various dodecenyl group, various tridecenyl group, various tetradecenyl group, various pentadecenyl group, cyclohexyl group, dimethylcyclohexyl group, ethylcyclohexyl group, methylcyclohexylmethyl group, cyclohexylethyl group, propylcyclohexyl group, butylcyclohexyl group, heptylcyclohexyl group, phenyl group, tolyl group, dimethylphenyl group, butylphenyl group, nonylphenyl group, methylbenzyl group, phenylethyl group, naphthyl group, and dimethylnaphthyl group. The Mo amine salt is a molybdic acid secondary amine salt represented by the following general formula (III).

(III)

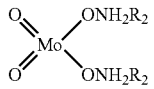

In the general formula (III), R is a hydrocarbon group having from 5 to 18 carbon atoms, and the four hydrocarbon groups may be the same or different from each other. Examples of the hydrocarbon group having from 5 to 18 carbon atoms include: an alkyl group having from 5 to 18 carbon atoms, an alkenyl group having from 5 to 18 carbon atoms, a cycloalkyl group having from 5 to 18 carbon atoms, an alkylaryl group having from 5 to 18 carbon atoms, and an arylalkyl group having from 5 to 18 carbon atoms. Concrete examples of the hydrocarbon having from 5 to 18 carbon atoms include: various pentyl group, various hexyl group, various heptyl group, various octyl group, various nonyl group, various decyl group, various undecyl group, various dodecyl group, various tridecyl group, various tetradecyl group, various pentadecyl group, various hexadecyl group, various heptadecyl group, various octadecyl group, various octenyl group, various nonenyl group, various decenyl group, various undecenyl group, various dodecenyl group, various tridecenyl group, various tetradecenyl group, various pentadecenyl group, cyclohexyl group, dimethylcyclohexyl group, ethylcyclohexyl group, methylcyclohexylmethyl group, cyclohexylethyl group, propylcyclohexyl group, butylcyclohexyl group, heptylcyclohexyl group, phenyl group, tolyl group, dimethylphenyl group, butylphenyl group, nonylphenyl group, methylbenzyl group, phenylethyl group, naphthyl group, and dimethylnaphthyl group.

Among the above molybdenum-based friction modifiers, the MoDTC is preferable in terms of effect. The molybdenum-based friction modifier to be used can be one kind, or combination of two or more kinds, and the amount thereof should be 10 to 1000 mass ppm, preferably 100 to 800 mass ppm, in terms of amount of the molybdenum, based on the total amount of engine oil composition. If amount of the molybdenum is less than 10 mass ppm, sufficient low friction characteristic can not be obtained; while if amount of the molybdenum is more than 1000 mass ppm, frictional performance can not be further improved in proportion to the increment of the molybdenum.

It is preferred that the engine oil composition of the present invention is to be further blended with an amine-based antioxidant as a component (D). Examples of the amine-based antioxidant include: dialkyldiphenylamines such as p,p'-dioctyldiphenylamine (manufactured by the Seiko Chemical Co., Ltd. under the trade designation "Nonflex OD-3"), p,p'-di-alpha-methylbenzyl-diphenylamine and N-p-butylphenyl-N-p'-octylphenylamine; monoalkyldiphenylamines such as mono-t-butyldiphenylamine and monooctyldiphenylamine; bis(dialkylphenyl)amines such as di(2,4-diethylphenyl)amine and di(2-ethyl-4-nonylphenyl)amine; alkylphenyl-1-naphthylamines such as octylphenyl-1-naphthylamine and N-t-dodecylphenyl-1-naphthylamine; arylnaphthylamines such as 1-naphthylamine, phenyl-1-naphthylamine, phenyl-2-naphthylamine, N-hexylphenyl-2-naphthylamine and N-octylphenyl-2-naphthylamine; phenylenediamines such as N,N'-diisopropyl-p-phenylenediamine and N,N'-diphenyl-p-phenylenediamine; and phenothiazines such as phenothiazine (manufactured by the Hodogaya Chemical Co., Ltd.) and 3,7-dioctylphenothiazine.

Of these, the bis(dialkylphenyl)amines are preferable to be selected in terms of antioxidant effect and solubility.

The amount of the amine-based antioxidant to be compounded is preferably 50 to 2000 mass ppm, more preferably 200 to 1500 mass ppm, based on the total amount of engine oil composition. If the amount of the amine-based antioxidant is less than 50 mass ppm, the effect of restraining the deposit will be insufficient; while if the amount of the amine-based antioxidant is more than 2000 ppm, the effect of restraining the deposit will not be further improved.

Note that, within the range in which the objects of the present invention are not impaired, the engine oil composition of the present invention can contain various other additives to be used in conventional engine oil, such as a metal detergent, an ashless detergent dispersant, an antiwear agent, a pour point depressant, a rust inhibitor, a corrosion inhibitor, a defoaming agent, and other antioxidants. Examples of the metal detergent include: calcium sulfonate, magnesium sulfonate, barium sulfonate, calcium phenate, barium phenate, calcium salicylate, and magnesium salicylate, and all these are usually used at a ratio of 0.1 to 5 mass %. Examples of the ashless detergent dispersant include: succinimide-based ashless detergent dispersant, succinamide-based ashless detergent dispersant, benzylamine-based ashless detergent dispersant or its boron derivative, ester-based ashless detergent dispersant, and all these are usually used at a ratio of 0.5 to 7 mass %. Examples of the antiwear agent include: metal (Zn, Pb, Sb, or the like) thiophosphate, metal (Zn or the like) thiocarbamate, sulfur compound, phosphate ester, and phosphite ester, and all these are usually used at a ratio of 0.05 to 5.0 mass %. Examples of the rust inhibitor include alkenylsuccinic acid and partial ester thereof; examples of the corrosion inhibitor include benzotriazole and benzimidazole; and examples of the antifoaming agent include dimethylpolysiloxane and polyacrylate. All these can be added according to necessity.

Since the engine oil composition is obtained by adding the additives of the component (B) and the component (C) to the component (A) which is base oil mixture composed of base oil (a) and base oil (b), and since the amounts of the component (B) and the component (C) are respectively within the ranges specified above, the deposit generated during operation of the engine can be reduced, and thereby high-temperature detergency can be achieved. Further, since the base oil mixture is obtained by blending the base oil (a) and base oil (b), both having suitable viscosity and viscosity index, the engine oil composition has suitable viscosity and low temperature dependency of the viscosity, and therefore having low fuel consumption characteristic.

As for preparing method, the engine oil composition of the present invention can be prepared by blending the base oil (a), the base oil (b), and the additives of the component (B), the component (C) and the component (D), according to necessity, and the order of blending is not specified. For example, the additives can be added one by one into the base oil mixture composed of the base oil (a) and the base oil (b), or the additives can be mixed with each other previously and then the mixed additives are added to the base oil (a), the base oil (b), or the base oil mixture.

EXAMPLES

The present invention will be described in further detail with the following Examples and Comparisons, but the present invention is not intended to be limited to the details of these examples and the like.

Examples 1 to 4, and Comparisons 1 to 4

The engine oil compositions of the present invention exemplified in Examples 1 to 4 and the engine oil compositions of Comparisons 1 to 4 were prepared by blending the base oil (a), the base oil (b), and the additives in the ratio shown in Table 1, The "preparation" in Table 1 means that the amount of the base oil (a) was so prepared that the sum of all components of the engine oil composition became 100 mass %. Incidentally, commercially available additives for engine oil (such as an antiwear agent, a detergent, a dispersant, a defoaming agent, a rust inhibitor, and the like) were added in the engine oil composition of these Examples and Comparisons in an amount of 2000 mass ppm, in terms of amount of Ca. All of these engine oil compositions had viscosity grade of API0W-20.

(1) Base Oil (a)

A mineral oil (paraffinic base oil) including 99 mass % saturated hydrocarbon content and 0.02 mass % or less sulfur content was used, the base oil having a kinematic viscosity of 21.1 $mm^2/s$ at 40° C., a kinematic viscosity of 4.47 $mm^2/s$ at 100° C., and a viscosity index of 126.

(2) Base Oil (b)

A mineral oil (paraffinic base oil) including 77 mass % saturated hydrocarbon content and 0.19 mass % sulfur content was used, the base oil having a kinematic viscosity of 19.7 $mm^2/s$ at 40° C., a kinematic viscosity of 4.05 $mm^2/s$ at 100° C., and a viscosity index of 103.

(3) Oil-soluble molybdenum-containing Composition

Used was the oil-soluble molybdenum-containing composition prepared with the following method:

250 g of bis-succinimde and 162.5 g of neutral oil are placed in a glass reactor equipped with a thermoregulator, a mechanical agitator, and a water-cooling unit, the bis-succinimde being synthesized from a mixture of polyisobutenyl (mol. wt.:1000) succinic anhydride (PIBSA) and polyethylene polyamine oligomer, which is commercialized as polyethyleneamine E-100 from Huntsman Chemical Company, in a molar ratio of amine to PIBSA of 0.5:1, The mixture was heated up to 70° C., which is temperature of salt forming reaction of molybdic acid. 26.6 g of molybdenum oxide and 45.8 g of water are added to the reactor while maintaining the temperature unchanged. Then the temperature of the reactor is maintained at 70° C., which is the reaction temperature, for 28 hours. After the salt forming reaction of molybdic acid is completed, the product is distilled for 30 minutes at a temperature of 99° C. and under a pressure of 25 mmHg (absolute) or lower to remove the water. The product contained 4.01 mass % of molybdenum and 1.98 mass % of nitrogen.

(4) Molybdenum-based Friction Modifier

MoDTC (SAKURA-LUBE 515 manufactured by Asahi Denka Co., Ltd.) was used.

(5) Amine-based Antioxidant

Diphenylamine-based antioxidant (IRGANOX-L57 manufactured by Ciba-Geigy Japan Ltd.) was used.

[Evaluation Method]

High-temperature oxidation stability (high-temperature detergency) of the engine oil compositions exemplified in the above Examples and Comparisons were evaluated by TEOST (Thermo-oxidation Engine Oil Simulation Test), specifically, evaluated based on "TEOST PROTOCOL 33C".

TEOST PROTOCOL 33C:

116 ml of sample oil added with iron naphthenate as a catalyst to 100 mass ppm, calculated as iron concentration, is circulated at a rate of 0.40 g/min inside a container (low temperature portion: 100° C.) and an iron tube (high temperature portion: 200 to 500° C.) called as "depositor portion", under the following conditions.

Step 0: the temperature is increased to 200° C.

Step 1: the temperature is maintained at 200° C. for 75 seconds

Step 2: the temperature is increased from 200° C. to 480° C. over a period of 60 seconds Step 3: the temperature is maintained at 480° C. for 120 seconds Step 4: the temperature is lowered from 480° C. to 200° C. over a period of 240 seconds Step 5: the temperature is maintained at 200° C. for 75 seconds The above 5 steps constitute one cycle, and after twelve cycles (114 minutes) are performed, the deposit adhered on a depositor rod and the deposit contained in the sample oil is measured as the total amount of deposit (mg).

TABLE 1

| | Example 1 | Example 2 | Example 3 | Example 4 | Comparison 1 | Comparison 2 | Comparison 3 | Comparison 4 |
|---|---|---|---|---|---|---|---|---|
| Base oil (a) [1] | preparation | preparation | preparation | preparation | preparation | preparation | preparation | preparation |
| Base oil (b) [2] (mass %) | 5 | 5 | 10 | 15 | — | 5 | — | 20 |
| Mo-containing composition [3] (mass ppm) | 400 | 400 | 400 | 400 | 400 | — | — | 400 |
| Mo-based friction modifier [4] (mass ppm) | 400 | 400 | 400 | 400 | 400 | 400 | 400 | 400 |
| Amine-based antioxidant [5] (mass ppm) | 50 | 420 | 420 | 420 | 420 | 420 | 420 | 420 |
| Total amount of deposit (mg) | 55.6 | 51.4 | 53.7 | 57.1 | 61.5 | 61.2 | 63.5 | 68.1 |

[1] Mineral base oil: kinematic viscosity of 21.1 $mm^2/s$ at 40° C., kinematic viscosity of 4.47 $mm^2/s$ at 100° C., sulfur content of 0.02 mass % or less

[2] Mineral base oil: kinematic viscosity of 19.7 $mm^2/s$ at 40° C., kinematic viscosity of 4.05 $mm^2/s$ at 100° C., sulfur content of 0.19 mass %

[3] Oil-soluble molybdenum-containing composition (in terms of Mo content)

[4] MoDTC (in terms of Mo content)

[5] Diphenylamine-based (in terms of nitrogen content)

As shown in Table 1, it is obvious that the engine oil composition of the present invention has remarkably high effect of restraining the generation of the deposit compared to that of the Comparisons.

Also, the effect can be achieved only when the amount of the base oil (b) falls in a specified range based on the total amount of engine oil composition. That is, as can be known from Comparisons 1 to 4, the effect of restraining the generation of the deposit can not be well achieved if the content of the base oil (b) is too high or too low. In Comparison 4, for example, although the oil-soluble molybdenum-containing composition (c), the MoDTC (d), and the amine-based antioxidant (e) are added, the amount of deposit is 68.1 mg, which is the worst value. These facts mean that the effect of restraining the generation of the deposit can not be improved by only changing the type of the additives (antioxidant) or increasing the contents thereof, but synergistic effects of the base oils and the additives is important. In other words, the effect of restraining the generation of the deposit can be well achieved only when the amount of the base oil (a), the based oil (b), the oil-soluble molybdenum-containing composition (c), and the MoDTC (d) respectively fall in specified ranges.

The priority application Number JP2005-178381 upon which this patent application is based is hereby incorporated by reference.

What is claimed is:

1. An engine oil composition, consisting essentially of:

(A) a base oil mixture comprising a first base oil and a second base oil, the first base oil having a kinematic viscosity of 2 to 50 $mm^2/s$ at 100° C., a viscosity index of 80 or higher, and a sulfur content of less than 0.03 mass %, the second base oil having a kinematic viscosity of 2 to 50 $mm^2/s$ at 100° C., a viscosity index of 60 or higher, and a sulfur content of 0.03 mass % or more;

(B) an oil-soluble molybdenum-containing composition which is prepared by reacting an acid molybdenum compound or a salt thereof with succinimide at a temperature of of 120° C. or lower to form a product (m); and subjecting product (m) to a stripping process, a sulfurizing process, or a combination of these at a temperature of 120° C. or lower to produce an oil-soluble molybdenum-containing composition having a light absorbance of less than 0.7 at a wavelength of 350 nm; and (C) a molybdenum-based friction modifier, wherein based on the total amount of engine oil composition, the content of the second base oil is 1 to 15 mass %, the content of (B) oil-soluble molybdenum-containing composition is 50 to 1000 mass ppm in terms of amount of molybdenum, and the content of (C) molybdenum-based friction modifier is 100 to 1000 mass ppm in terms of amount of molybdenum.

2. The engine oil composition according to claim 1, further comprising:

(D) an amine-based antioxidant in an amount of 50 to 2,000 mass ppm in terms of amount of nitrogen based on the total amount of engine oil composition.

3. The engine oil composition according to claim 1, wherein the first base oil has a saturated hydrocarbon content of 90 mass % or more.

4. The engine oil composition according to claim 1, wherein the second base oil has a saturated hydrocarbon content of 90 mass % or less.

5. The engine oil composition according to claim 1, wherein (C) is selected from the group consisting of molybdenum dithiocarbamate, molybdenum dithiophosphate, and molybdic acid amine salt.

6. The engine oil composition according to claim 1, wherein the first base oil, the second base oil, or both have a kinematic viscosity of 3 to 30 $mm^2/s$ at 100° C.

7. The engine oil composition according to claim 1, wherein the first base oil, the second base oil, or both have a kinematic viscosity of 4 to 25 $mm^2/s$ at 100° C.

8. The engine oil composition according to claim 1, wherein the first base oil, the second base oil, or both have a viscosity index of 90 or higher.

9. The engine oil composition according to claim 1, wherein the first base oil, the second base oil, or both have a viscosity index of 100 or higher.

10. The engine oil composition according to claim 1, wherein the first base oil, the second base oil, or both are a mineral oil.

* * * * *